US005275274A

United States Patent [19]

Anderheggen et al.

[11] Patent Number: 5,275,274

[45] Date of Patent: Jan. 4, 1994

[54] APPARATUS FOR DOFFING BOBBIN TUBES FROM SUPPORT MEMBERS

[75] Inventors: Manfred Anderheggen; Ulrich Wirtz, both of Monchen-Gladbach, Fed. Rep. of Germany

[73] Assignee: W. Schlafhorst AG & Co., Moenchengladbach, Fed. Rep. of Germany

[21] Appl. No.: 994,360

[22] Filed: Dec. 21, 1992

[30] Foreign Application Priority Data

Dec. 21, 1991 [DE] Fed. Rep. of Germany ..... 4142620

[51] Int. Cl.[5] ..... B65G 37/00

[52] U.S. Cl. ..... 198/465.1; 198/487.1; 198/604; 198/374; 198/406; 414/417; 242/35.5 A

[58] Field of Search ..... 198/457, 465.1, 487.1, 198/598, 604, 626.6, 803.12, 406, 416, 374; 414/416, 417; 209/617, 618, 927; 242/35.5 A

[56] References Cited

U.S. PATENT DOCUMENTS

| | | | |
|---|---|---|---|
| 4,544,107 | 10/1985 | Matsui et al. . | |
| 4,601,434 | 7/1986 | Mori et al. . | |
| 4,660,367 | 4/1987 | Kawarabashi . | |
| 4,674,636 | 6/1987 | Sakitani et al. . | |
| 4,753,336 | 6/1988 | Taylor et al. | 198/487.1 |
| 4,834,811 | 7/1989 | Yamamoto et al. . | |
| 4,845,937 | 7/1989 | Kiriake et al. . | |
| 4,940,127 | 7/1990 | Kikuchi et al. . | |
| 5,184,713 | 2/1993 | Nakagawa | 198/465.1 |

FOREIGN PATENT DOCUMENTS

| | | |
|---|---|---|
| 3535219A1 | 4/1986 | Fed. Rep. of Germany . |
| 3815831A1 | 12/1988 | Fed. Rep. of Germany . |
| 4008795A1 | 9/1990 | Fed. Rep. of Germany . |
| 4024787C1 | 10/1991 | Fed. Rep. of Germany . |
| 46-4515 | 2/1971 | Japan . |
| 49-26531 | 3/1974 | Japan . |
| 5225139 | 8/1975 | Japan . |
| 1170660 | 11/1969 | United Kingdom . |

*Primary Examiner*—Joseph E. Valenza
*Attorney, Agent, or Firm*—Shefte, Pinckney & Sawyer

[57] ABSTRACT

An apparatus for doffing textile bobbin tubes from tube support members having posts projecting therefrom for supporting tubes thereon as the tube support members are conveyed along a transport path by a transport device with the tube support members being slidably supported on the transport device to allow stoppage of a tube support member as a tube is doffed without deactivating the transport device is disclosed. The tube doffing apparatus comprises a pair of opposed tube engaging and doffing devices having tube engaging surfaces which may be conveyor belts with guide and support rollers straddling the path of posts of support members traveling along the transport path and extending away from the transport path in the general direction of projection of the support member posts. These devices are disposed for engaging a tube on a post of a support member supported on the transport path and thereby stopping the support member while removing the tube from the post. The surfaces converge transversely in the downstream direction of the transport path from an upstream spacing therebetween greater than the transverse extent of the tube on a support member to a downstream spacing less than the transverse extent of a tube and greater than the transverse extent of the post of the tube support member to allow a support member from which a tube has been removed to resume travel along the transport path past the doffing apparatus.

8 Claims, 2 Drawing Sheets

APPARATUS FOR DOFFING BOBBIN TUBES FROM SUPPORT MEMBERS

FIELD OF THE INVENTION

The invention relates to an apparatus for doffing bobbin tubes from tube support members traveling on conveyors.

BACKGROUND OF THE INVENTION

Tubes that accumulate after bobbins have been unwound in a textile winding machine and that are conveyed on tube support members having posts on which the tubes are supported must be doffed from the posts before full bobbins are mounted on the posts for conveyance to the spinning machine. Various kinds of equipment have been proposed for this purpose.

Doffers that operate with grippers such as U.S. Pat. No. 4,660,367 have gained widespread acceptance. Such doffers are relatively complicated and do not permit a high throughput capacity. The throughput capacity of such doffers can be improved, by providing a plurality of grippers. For example, in Swiss Patent 424 568 the grippers are moved synchronously with the posts of the bobbins on a spinning machine for a predetermined portion of the path. An apparatus of this kind is also relatively complicated and requires a closely and accurately spaced arrangement of the bobbins.

U.S. Pat. No. 4,674,636 discloses a doffer that doffs the tubes by use of an endless belt and an opposed plate that move against a tube positioned therebetween. It requires actuating devices, so as to be actuated in a synchronous manner tuned to the delivery of the tubes to be doffed. Additionally, U.S. Pat. No. 4,674,636 has a single substantially vertically extending doffing belt as well as a roller. Both the doffing belt and the roller are movable from a retracted position out of engagement with a tube to a tube engaging position. Once again this requires synchronization of the device with the bobbins and also requires a mechanism for moving the components into and out of operating position.

German Patent Document 4024787Cl discloses a device for doffing of tubes having two opposed doffing belts inclined obliquely upward in a wedge-like fashion to grasp the lower ends of tubes and progressively remove them from posts fixed to a main conveyor belt as the conveyor advances. This requires synchronization of the movement of the doffing belts and the posts fixed to the main conveyor.

SUMMARY OF THE INVENTION

It is an object of the present invention to provide an apparatus for doffing bobbin tubes from traveling support members that is simple in structure and enables a high throughput capacity.

The present invention is in the form of an apparatus for doffing textile bobbin tubes from tube support members having posts projecting therefrom for supporting tubes thereon as the tube support members are conveyed along a transport path by a transport device with the tube support members being slidably supported on the transport device to allow stoppage of a tube support member as a tube is doffed without deactivating the transport device. The tube doffing apparatus comprises a pair of opposed tube engaging and doffing devices having tube engaging surfaces straddling the path of posts of support members traveling along the transport path and extending away from the transport path in the general direction of projection of the support member posts. These devices are disposed for engaging a tube on a post of a support member supported on the transport path and thereby stopping the support member while removing the tube from the post. The surfaces converge transversely in the downstream direction of the transport path from an upstream spacing therebetween greater than the transverse extent of the tube on a support member to a downstream spacing less than the transverse extent of a tube and greater than the transverse extent of the post of the tube support member to allow a support member from which a tube has been removed to resume travel along the transport path past the doffing apparatus.

The tube engaging and doffing devices preferably include conveyor belts forming the tube engaging surfaces and devices for driving the belts along the surfaces away from the transport path. The tube engaging and doffing devices may include conveyor belt guide rollers for guiding the conveyor belts adjacent the transport path to form the surfaces, and conveyor belt support rollers for supporting the belts in the surface formation, the support rollers associated with one surface being disposed alternatingly offset with respect to the rollers associated with the other surface. The belt guide rollers and belt support rollers may be disposed rotatably but about fixed axes and the belt guide rollers and belt support rollers associated with each conveyor belt may be spaced apart a distance that is at least equivalent to the length of the tubes to be doffed.

Preferably, a tube retaining means is disposed between the upstream edges of the converging surfaces above the height of the posts of the tube support members for preventing tilting of the tubes out of engagement by the surfaces as they are being doffed.

In the preferred embodiment, at least one of the doffing conveyor belts is guided at the outer end of the doffing surfaces to extend transversely away from the surfaces for conveying a doffed tube away from the surfaces. This embodiment may also include a device adjacent the outer ends of said surfaces for selectively deflecting the leading end of the tubes for discharge of the tubes onto the transversely extending belt selectively leading end or trailing end first. The device for selectively deflecting may deflect the tubes alternately leading end and trailing end first so that conical tubes can be compactly and orderly contained as they are discharged from the doffing apparatus.

DESCRIPTION OF THE PREFERRED EMBODIMENT

Figure 1:
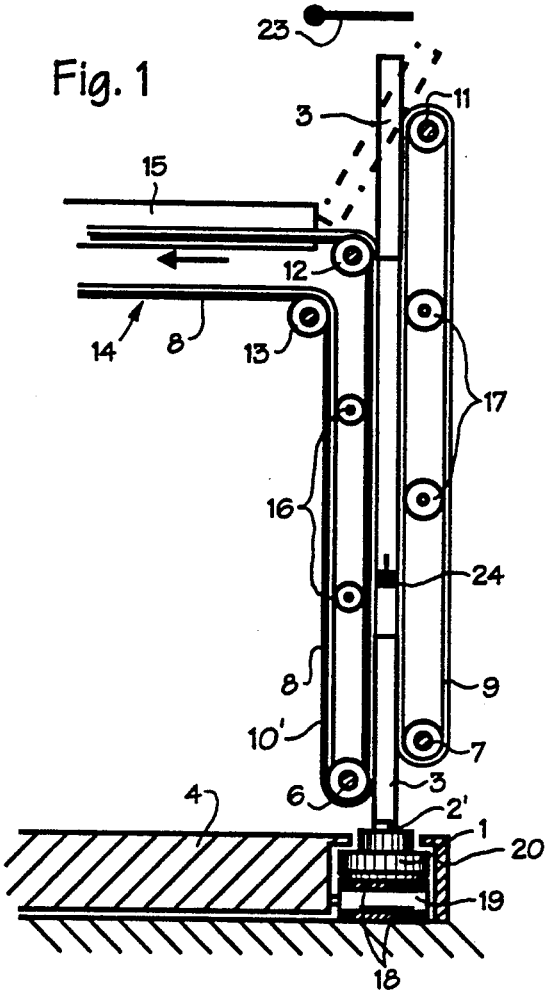
FIG. 1 is a vertical sectional view of the apparatus according to the preferred embodiment of the present invention, viewed in the direction of transport of the tube support members.
Figure 2:
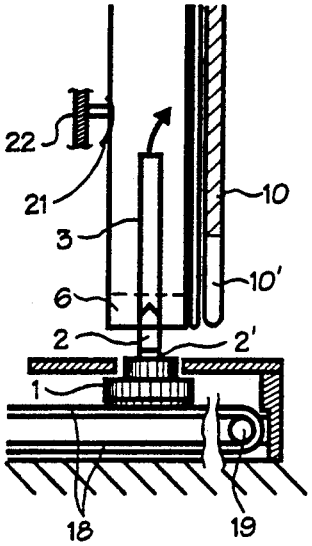
FIG. 2 is a vertical sectional view of a fragment of the apparatus of FIG. 1 as viewed transversely with respect to FIG. 1.

Referring now to FIGS. 1 and 2, tube support members 1 with empty tubes 3, which were removed from the winding stations of a bobbin winding machine, are delivered along a transport path 5, disposed in a base plate 4 of the bobbin winder, by means of a conveyor belt 18. A guide roller 19 is shown within a transport channel 20. The tubes 3 are carried on posts 2 of tube support members 1 with the tube base resting on a shoulder 2' of the post 2.

Figure 3:
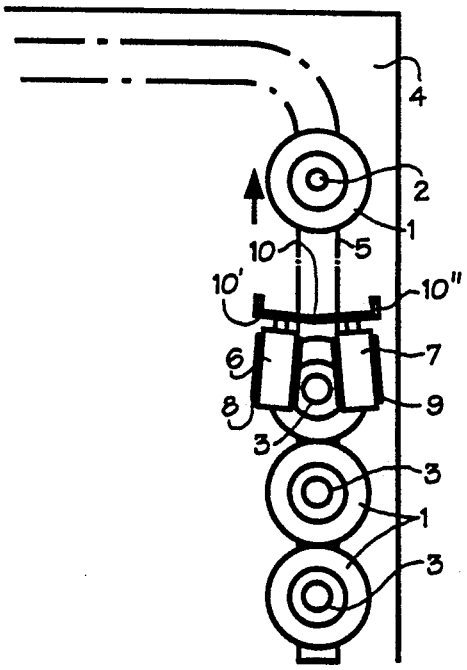
FIG. 3 is a horizontal sectional view of the apparatus of FIG. 1.

As can be seen in FIG. 3, lower guide rollers 6 and 7 for conveyor belts 8 and 9, respectively, are disposed in such a way as to form surfaces converging transversely in the downstream direction of the transport path from an upstream spacing therebetween greater than the transverse extent of a tube 3 on support members 1 to a downstream spacing less than the transverse extent of the post of the tube support member 1 to allow a support member from which a tube 3 has been removed to resume travel along the transport path past the doffing apparatus. These surfaces form a wedge-shaped gap.

The conveyor belts 8 and 9 are driven by drive motors such that the runs facing one another produce a transport direction that is substantially vertically upward. It is desirable that no special demands be made of the drive motor control, because the drive of these conveyor belts is continuous.

The conveyor belts 8 and 9 are reinforced by belt support rollers 16 and 17, respectively, along the transport path of the doffed tubes 3, to assure reliable guidance of the tubes 3. One of the conveyor belts may be guided at the outer end of the doffing surfaces to extend transversely away from the surfaces for conveying a doffed tube away from the surface. This may be accomplished by deflecting belt 9 by an upper guide roller 11, while the conveyor belt 8 may be guided by guide rollers 12 and 13 into a horizontal portion 14. An outer guide roller (not shown) guides the return of the conveyor belt 8.

The disposition of the belt support rollers 16 and 17 and of the guide rollers 11 and 12, and of the belt guide rollers 6 and 7 is fixed as shown in FIG. 3, i.e., the wedge-shaped gap in this form extends over the entire vertical transport path of the two conveyor belts 8 and 9.

The mutual vertical spacing of the guide and support rollers, each associated with one of the belts 8 or 9, is preferably selected to be great enough so that it is greater than the maximum length of the tubes 3 to be doffed. This is required in those cases in which the guide and support rollers are supported in fixed fashion. This avoids jamming of the tubes 3. On the other hand, there is no such requirement if the guide and support rollers are yieldingly or resiliently supported. In any case, fixedly supporting them is easy to do and also produces very reliable doffing of the tubes 3.

The guide rollers 6 and 7 as well as 11 and 12 and the support rollers 16 and 17 may be offset alternatingly with respect to one another; as a result, despite the described distances between them, the doffed tube 3 is always supported directly by at least one of the rollers.

As can be seen from FIG. 3, the tube support members 1 arrive in close succession at the doffer. This is possible because the conveyor belts 8 and 9 doff the tubes 3 in a virtually continuous manner. Each tube that enters the transversely converging surfaces is engaged by both belts 8 and 9 and transported speedily away as soon as the gap width attains the outer diameter of the tube. Once the tube 3 has left the post 2, it can release the slidably supported tube support member 1, which has briefly slidably maintained its position on the transport path and which passes through the transversely converging surfaces. This tube support member is engaged by the conveyor belt 18 again and allows the following tube support member 1 to enter the wedge-shaped gap formed by the converging surfaces.

If the belt speed of the conveyor belts 8 and 9 is high enough, the base of the tube 3 that has just been doffed is already above the level of the tube tip transported into the doffer, so that the tubes will not touch one another. Especially with relatively short tubes, this is completely unproblematical. Thus, to prevent successive, relatively long tubes from abutting one another in the process, the transport speed of the doffing belts may be raised relative to the transport speed of the conveyor belt bringing the tube support members to the doffing belts. Another option is to separate the tube support members upstream of the doffer by leaving empty tube support members between tubes. It is not crucial to have equal time intervals or to match any increments of motion of the doffing belts, because of the tube support members being slidably supported and because the doffing belts are always in readiness for doffing a tube as a result of their fixed disposition. In this way, a high capacity for doffing the tubes can be attained. No particular synchronization or cycling order is needed, and so the process is greatly simplified.

In the event that very long tubes must be doffed, then it is also possible to separate the tube support members beforehand. This can be done by means of an incrementally switched stopper or other known means for separation of articles transported in close succession. In this case as well, there is no need to adapt the doffer to this separator.

As can be seen in FIG. 2, a guide profile 21 is disposed at the inlet of the wedge-shaped gap by means of a retainer 22; this profile is provided in the event that a tube is not inclined in the direction indicated by the arrow, with its tube tip slightly in the direction of the narrowest point of the wedge-shaped gap. This inclination, which is due to the conical shape of the tubes, is as a rule assumed by the tubes 3 immediately after the doffing. However, because of some irregularity in the course of motion, for instance, such a tube after being doffed from the post 2 of the tube support member 1 may tilt backward with its tip in the direction of the larger opening of the wedge-shaped gap. Then the tip of that tube 3 strikes the guide profile 21, which returns the tube to the usual transport position. To that end, tube retaining device 21 is disposed between the upstream edge of the converging surfaces above the height of the posts of the tube support members. Thus, the retaining device 21 is relatively close above the level of the tube tips of the incoming tubes 3 and does not hinder the entry of these tubes 3 into the doffer.

As can be seen from FIG. 3, the lower guide rollers 6 and 7 for the conveyor belts 8 and 9 are supported on trunnions of a retainer 10. It is possible, although not shown here, for these trunnions for the guide rollers 6 and 7 to be disposed in oblong slots in the retainer 10, within which they are adjustable in order to vary the size of the wedge-shaped gap. In any case, because of the depth of the wedge-shaped gap, the region of variable diameter is so large that the same wedge-shaped gap is suitable for tubes having relatively widely varying diameters.

The retainer 10, seen in the cross-sectional view of FIG. 3, extends along the two conveyor belts 8 and 9 and, advantageously, is likewise also guided at the outer end of the doffing surfaces transversely away from the surfaces, like the conveyor belt 8, so that it carries not only the guide rollers 12 and 13 but additionally the aforementioned guide roller, not shown, of the conveyor belt 8. Obviously, however, it is also possible for a different retainer to be provided for the horizontal part 14.

As can be seen from the figures, in this exemplary embodiment the retainer 10 has outriggers 10, and 10'', to which the guide rollers 6 and 7 are attached. As a result, a larger passage for posts 2 is made free in the middle. However, this is necessary only in cases in which the post is of such a length that its free passage after the doffing of the applicable tube 3 between the guide rollers 6 and 7 would be hindered. With the length of the post 2 as shown and the offset of the two lower guide rollers 6 and 7, however, a lower chamfer of the retainer 10 may possibly already suffice. Moreover, the possibility also exists of disposing each of the lower guide rollers, but at least guide roller 6, at a somewhat higher level.

Figure 4:
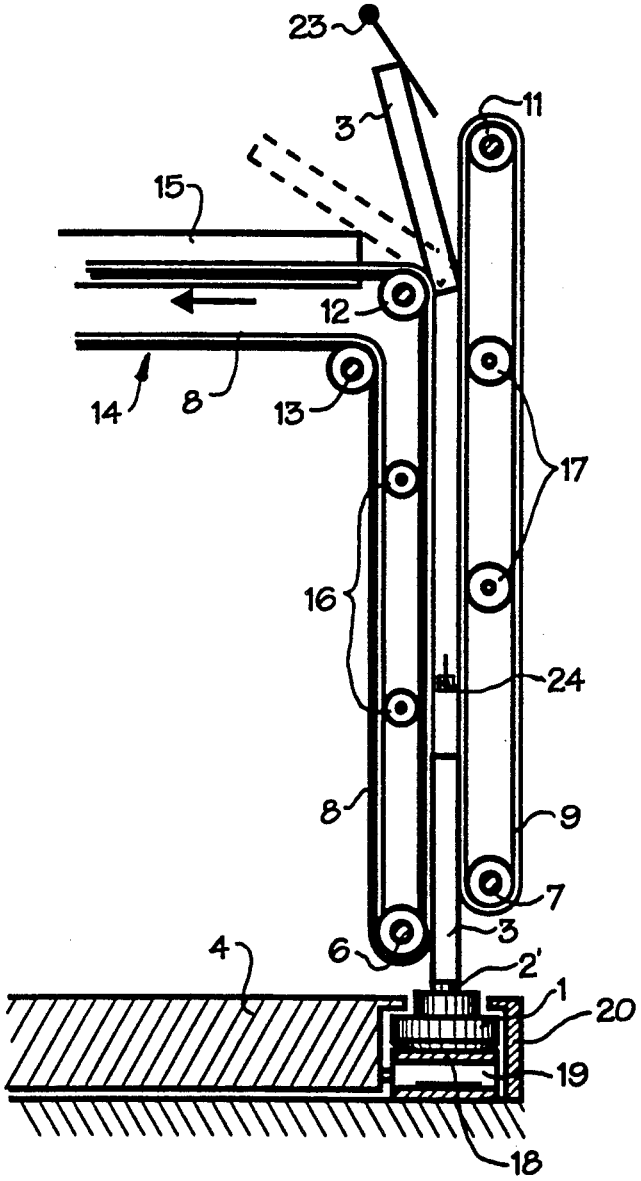
FIG. 4 is a vertical sectional view corresponding to FIG. 1, with a tube tilted by a deflector element.

Since one of the belts at its upper end extends transversely away from the surfaces, the tube removal, for example to a tube collecting device such as a container, is assured at the same time. Moreover, since it is desirable in many cases for the tubes to be deposited in a collecting container with their tips offset from one another, which proves to be especially space-saving when the shape of the tubes is conical. Then, a device for tilting the tubes at this point may be provided which is preferably a deflector element, which may deflect every other tube in the opposite direction. FIGS. 1 and 4 show different variants of the deflecting of the tubes 3 into the horizontal plane. In FIG. 1 a switch plate 23 is pivoted upward out of contact with the tip of the tube 3, this tube 3 is transported with its base or trailing end leading in the transverse plane 13 away from the conveyor belt 8, as shown in dot-dash lines and additionally marked by an arrow. This is achieved by keeping the tube virtually vertical by the guide rollers 11 and 12 and then engaging the tube in the transverse transport direction of the conveyor belt 8 by that belt which changes to the transverse direction.

In the view shown in FIG. 4, the switch plate 23 is pivoted downward, so that the leading end of the tube 3 strikes this switch plate 23 and is deflected onto the transversely extending belt. This tube 3 is then transported onward, with its leading end leading, in the horizontal direction. The switch plate 23 may be a switch operated, for example, by a rotary solenoid or by a fluid cylinder. The actuation of this switch plate 23 may be a response to signals of a sensor 24 disposed in the transport path. This conventional sensor detects the passage of a tube and effects the switchover of the switch plate 23 to its other position at any given time.

The tubes 3 that are transported by the conveyor belt 8 in the transversely extending plane 14 are prevented from leaving the conveyor belt 8 by lateral guide plates 15.

The alternatingly differing deflecting of the tubes 3 into the transverse direction 14 serves the purpose of later space-saving depositing of conical tubes. Because the tubes have the same conicity, they always produce a horizontal deposit surface where the trailing end one of and the leading end of another tube lie next to one another.

In summary, an efficient, simple and versatile method and apparatus for doffing tubes positioned on slidably supported tube support members is disclosed. The tubes are doffed with a pair of preferably vertically extending surfaces, typically conveyor belts, positioned at a point on the tube support member transport path that engages the tubes, between a wedge-shaped gap formed by the surfaces.

The converging surfaces in combination with the substantially vertical disposition of the conveyor belts doffing the tubes and the ability of the tube support members to slide upon reaching the surfaces so as not to require stopping conveyor belt of the transport path, assures virtual continuous doffing of tubes without the doffing means having to execute a movement that is incrementally matched to the delivery of the tubes to achieve that end. Thus, a stop device for the tube support member arriving in the tube doffing position is not needed, because the stopping is automatically brought about by the entry of the tube into the converging surfaces and the ability of the tube support members to slide on the conveyor belt. It is accordingly also possible to handle tubes of different dimensions, because the wedge-shaped gap can engage any dimension greater than the width of the gap.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An apparatus for doffing textile bobbin tubes from tube support members having posts projecting therefrom for supporting tubes thereon as the tube support members are conveyed along a transport path by transport means with the tube support members being slidably supported on the transport means to allow stoppage of a tube support member without deactivating the transport means, said tube doffing apparatus comprising a pair of opposed tube engaging and doffing devices having tube engaging surfaces straddling the path of posts of support members traveling along the transport path and extending away from the transport path in the general direction of projection of the support member posts, said devices being disposed for engaging a tube on a post of a support member supported on the transport path and thereby stopping the support member while removing the tube from the post, said surfaces converging transversely in the downstream direction of the transport path from an upstream spacing therebetween greater than the transverse extent of a tube on a support member to a downstream spacing less than the transverse extent of a tube and greater than the transverse extent of the post of the tube support member to allow a support member from which a tube has been removed to resume travel along the transport path past said doffing apparatus.

2. The apparatus for doffing textile bobbin tubes of claim 1 wherein said tube engaging and doffing devices include endless conveyor belts forming said tube engaging surfaces and means for driving said belts along said surfaces away from said transport path.

3. The apparatus for doffing textile bobbin tubes of claim 2 wherein said tube engaging devices include conveyor belt guide rollers for guiding said conveyor belts adjacent the transport path to form said surfaces and conveyor belt support rollers for supporting said belts in said surface formation, said support rollers associated with one surface being disposed alternatingly offset with respect to the rollers associated with the other surface.

4. The apparatus for doffing textile bobbin tubes of claim 3, wherein said belt guide rollers and the belt support rollers are disposed rotatably about fixed axes and the belt guide rollers and belt support rollers associated with each conveyor belt are spaced apart a distance that is at least equivalent to the length of the tubes to be doffed.

5. The apparatus for doffing textile bobbin tubes of claim 1 further comprising tube retaining means disposed between the upstream edges of said converging surfaces above the height of the posts of said tube support members for preventing tilting of the tubes out of engagement by the surfaces as they are being doffed.

6. The apparatus for doffing textile bobbin tubes of claim 2 wherein at least one of said doffing conveyor belts is guided at the outer end of the doffing surfaces to extend transversely away from the surfaces for conveying a doffed tube away from said surfaces.

7. The apparatus for doffing textile bobbin tubes of claim 6 further comprising means disposed adjacent the outer ends of said surfaces for selectively deflecting the leading end of tubes for discharge of tubes onto said transversely extending belt selectively leading end or trailing end first.

8. The apparatus for doffing textile bobbin tubes of claim 7 wherein said means for selectively deflecting deflects said tubes alternately leading end and trailing end first.

* * * * *